United States Patent [19]

Alder

[11] 4,098,651

[45] * Jul. 4, 1978

[54] CONTINUOUS MEASUREMENT OF ELECTROLYTE PARAMETERS IN A CELL FOR THE ELECTROLYSIS OF A MOLTEN CHARGE

[75] Inventor: Hanspeter Alder, Flurlingen, Switzerland

[73] Assignee: Swiss Aluminium Ltd., Chippis, Switzerland

[ * ] Notice: The portion of the term of this patent subsequent to Jan. 6, 1993, has been disclaimed.

[21] Appl. No.: 529,754

[22] Filed: Dec. 5, 1974

[30] Foreign Application Priority Data

Dec. 20, 1973 [CH] Switzerland ..... 17892/73

[51] Int. Cl.[2] ..... G01N 27/46

[52] U.S. Cl. ..... 204/1 T; 204/195 R; 204/67; 204/147; 204/196

[58] Field of Search ..... 204/1 T, 195 R, 67, 204/147, 148, 196, 197

[56] References Cited

U.S. PATENT DOCUMENTS

| | | | |
|---|---|---|---|
| 2,919,234 | 12/1959 | Slatin | 204/67 |
| 3,034,972 | 5/1962 | Lewis | 204/67 |
| 3,141,835 | 7/1964 | Rolin et al. | 204/1 T |
| 3,208,925 | 9/1965 | Hutchison et al. | 204/147 |
| 3,345,278 | 10/1967 | Mekjean | 204/147 |
| 3,400,062 | 9/1968 | Bruno et al. | 204/67 |
| 3,471,390 | 10/1969 | Kibby et al. | 204/195 R |
| 3,661,736 | 5/1972 | Holliday | 204/67 |
| 3,712,857 | 1/1973 | Piller | 204/67 |
| 3,718,550 | 2/1973 | Klein | 204/67 |
| 3,829,374 | 8/1974 | Kugler | 204/67 |
| 3,930,967 | 1/1976 | Alder | 204/67 |

*Primary Examiner*—T. Tung

*Attorney, Agent, or Firm*—Ernest F. Marmorek

[57] ABSTRACT

A process for the continuous measurement of the electrolyte parameters during the electrolysis of metallic compounds in particular aluminium oxide, dissolved in a melt. A measuring current of current density of at least 0.01 A/cm$^2$ with respect to the anodic measuring surface, is passed through an anodically polarized measuring probe which has a measuring surface whch is wet by the corrosive electrolyte and which is made of an inconsumable ceramic oxide material.

22 Claims, 6 Drawing Figures

Figure 1:
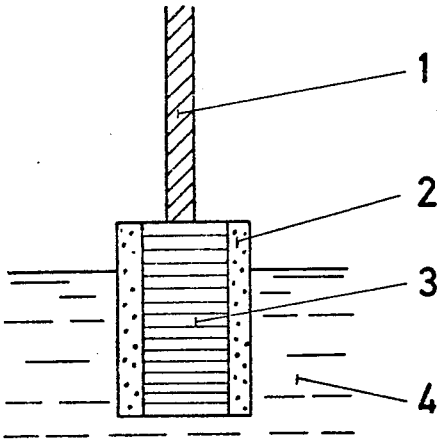

CONTINUOUS MEASUREMENT OF ELECTROLYTE PARAMETERS IN A CELL FOR THE ELECTROLYSIS OF A MOLTEN CHARGE

RELATED PATENTS AND APPLICATIONS

This application is related to my U.S. Pat. Nos. 3,930,697; 3,960,678; and 3,974,046; to my co-pending application Ser. No. 649,991, filed on Jan. 19, 1976; to Klein U.S. Pat. No. 3,718,550; and to Kugler et al. U.S. Pat. No. 3,829,374.

The invention concerns a process for the continuous measurement of electrolyte parameters during the electrolysis of metallic compounds, in particular of aluminium oxide, whereby a measuring probe with a surface coating of ceramic oxide material is used.

In the Hall-Heroult electrolytic process for the production of aluminium, a cryolite melt with aluminium oxide dissolved in it is electrolysed at 940° - 1000° C. The aluminium which separates out collects on the cathodic floor of the electrolysis cell, while on the carbon anodes $CO_2$ and to a lesser extent CO are formed. As a result of this the anode burns away.

At present the following parameters are measured continuously i.e. without taking samples, in order to control the cell operation:

Current consumed

Voltage

The following are also measured, but not continuously:

Chemical composition of the melt

Level of the metal in the cell

Current yield

Composition of the anode gas

At present it is either not possible to determine the following parameters or they can be determined only indirectly:

Temperature of melt

The composition of the melt at any given moment

Interpolar distance

Automation of the electrolysis process appears to be indispensible mainly for two reasons:

Enclosed cells require less manual operation

Labour costs are continuously rising

This means therefore that for various parameters which are not measured continuously, are not measured at all, or are obtained only indirectly, it must be made possible to measure them continuously.

One of the main reasons why less progress has been made with automation here than with other processes, has been the difficulty of finding a material for a measuring probe which is sufficiently stable in the strongly corrosive conditions of the molten electrolyte and which provides reproducible results over long periods of time.

The requirements of anodically polarized materials are as follows:

Thermal stability at the operating temperature

Resistance to attack by the molten electrolyte which contains suspended and/or dissolved metal.

Resistance to temperature changes; the materials must not be damaged on being introduced into the melt or when there are temperature fluctuations.

Electrically conductive to allow signals to be transmitted.

Clearly the number of materials which even approach fulfilling these extremely demanding criteria is very limited.

In the Swiss patent application No. 7522/73 there are described ceramic oxide materials which are employed as inconsumable anode surfaces in the electrolysis of molten oxide charges, in particular charges containing aluminium oxide.

Several publications, mainly by M. Rolin, are related to the potentiometric measurement of the $Al_2O_3$ content of molten cryolite charges which lie on top of a layer of molten aluminium. At least the working surfaces of the probes used consist of ceramic oxide materials. The potentiometric method is a method of analysis in which no current flows; the ceramic oxide materials which are immersed in the melt are attacked by the aluminium and therefore consumed. Also the reproducability of the value for the $Al_2O_3$ content obtained by the potentiometric method is not satisfactory.

The object of the invention is to develop a process for the continuous measurement of cell parameters during the electrolysis of metallic compounds, in particular aluminium oxide, dissolved in a molten charge, whereby the above mentioned difficulties are eliminated. In particular the measuring probe should not be at all consumed and should enable reproducible results to be obtained. The object is fulfilled by means of the invention in that a measuring current, of current density at least equal to 0.01 $A/cm^2$ with respect to the anodic surface area, is passed through an anodically polarized probe situated at least in the region of the three phase zone next to the melt by a ceramic oxide material, and is passed through the molten electrolyte and through a cathodically polarised inert electrode.

For the free ceramic oxide working surface of the probe which is in contact with the corrosive molten electrolyte, and which is designated as "the measuring surface", the following base materials come into consideration: oxides of tin, iron, cobalt, nickel or zinc or chromium.

These oxides can not usually be sintered to a high density without additives and furthermore at 1000° C they exhibit a relatively high specific resistance. In most cases therefore, additions of at least one other metal oxide in a concentration of 0.01 to 20 wt%, preferably 0.05 to 2% have to be made to improve the properties of the pure oxide.

The oxides of the following metals have proved to be useful additives, either by themselves or combinations of them, to increase the sinterability, the density and the conductivity:

Fe, Sb, Cu, Mn, Nb, Zn, Cr, Co, W, Cd, Zr, Ta, In, Ni, Ca, Ba, Bi

The processes which are known in ceramic technology can be used to manufacture ceramic oxide parts of this kind. The oxide mixture is ground, shaped using pressure or using a slurry, and sintered by heating to a high temperature.

The oxide mixture can also however be deposited as a coating on a substrate by cold or hot pressing, plasma or flame spraying, explosion coating, physical or chemical deposition from the gas phase or by another known method and then sintered if necessary. The bonding of the coating to the substrate is improved if the substrate surface is mechanically, electrically or chemically roughened or if a wire mesh is welded on to it before coating.

The following demands are made on the substrate material:

good electrical conductivity no reaction with the ceramic oxide material

The substrate is preferably of metal for example nickel, copper, heat resistant steel, cobalt or molybdenum; silver can be employed as an intermediate layer which is liquid at the operating temperature. Besides metals, carbides, nitrides, borides and/or silicides which fulfill the requirements also come into consideration. Such a substrate with the conductivity of a metal makes it easier to obtain a uniform distribution of current over the whole of the ceramic oxide working surface.

The ceramic oxide surfaces of the invention which are in contact with the molten electrolyte have the following advantages:

good performance when subjected to temperature fluctuations.

low solubility in the electrolyte at high temperature high electrical conductivity resistant to oxidation porosity can be varied Additions of metal oxide for example allow not only the electrical resistivity of the ceramic to the varied but also its temperature dependence within broader limits, depending on the requirements.

Investigations have shown that ceramic oxide materials, for example tin oxide, are relatively quickly consumed in the molten electrolyte if immersed in the electrolyte without carrying current. Since tin oxide according to the invention is resistant to attack by pure cryolite, apparently the following reaction with aluminium dissolved and suspended in the cryolite takes place:

$$3\ SnO_2 + 4\ Al \rightarrow 3\ Sn + 2\ Al_2O_3 \qquad (1)$$

If the ceramic oxide material in contact with the molten electrolyte is made to carry current then the corrosive attack is markedly reduced, practically to zero attack if the current density exceeds 0.01 A/cm$^2$ at all places; preferably however at least 0.025 A/cm$^2$ is used.

In practice however it has been found that under certain circumstances it is difficult to achieve a uniform current density over the whole ceramic surface in contact with the electrolyte, since this current distribution is dependent not only on the conductivity of the ceramic and the melt, but also on the geometry of the cell, the local flow behaviour, melt temperature and other factors. The current density can not only be non-uniform but can in certain circumstances below the prescribed minimum value, resulting in a corrosion reaction of the type given by equation (1) taking place.

In addition to superimposing a minimum current density therefore further suitable steps have to be taken to prevent this corrosive attack.

If a measuring probe is make to carry current, but is not completely immersed in the molten electrolyte, then those areas on the ceramic oxide surface which are simultaneously in contact with the melt and the surrounding atmosphere are particularly endangered. In this so-called three phase zone a considerable amount of material can be consumed in spite of the superimposed current. This region of the probe can be covered with materials which are stable and badly conducting under the operating conditions.

The measuring probe is preferably so arranged however, that the ceramic oxide surface is completely immersed in the electrolyte. If this immersed surface is not completely protected by an adequate current density then at least the endangered areas are protected by a stable and badly conductive material or an oxidizing gas is blown onto these areas.

The oxidizing gases can consist of the following, either individually or as mixtures:

Oxygen, air, chlorine, fluorine, carbon di-oxide and nitrogen oxide.

The gas can emerge at the desired areas through pores or channels coming out of the ceramic oxide surface of the anode in the electrolyte, or can be passed from outside through the electrolyte. Furthermore the measuring probe can be so designed that the anode gas produced, either by itself or together with the oxidizing gases supplied, is led from areas with a sufficiently high current density to those areas where the current density is less than the prescribed minimum value.

The electrolyte melt can, as is normal in practice, consist of fluoride, above all cryolite, or of a known oxide mixture as can be found in technical publications.

When in service, the measuring probe is always anodically polarised so that the ceramic oxide surface is protected from reduction by metal in solution or in suspension. The current density is then preferably so arranged that it is definitely above the prescribed minimum. This means however that at the ceramic oxide surface a part of the metal oxide which is dissolved in the electrolyte is decomposed to its elements.

The purpose of the arrangement according to the invention, is not to produce metal but to obtain the continuously variable parameters relating to the electrolyte during the reduction process, in particular in the electrolytic production of aluminium.

The voltage drop ceramic oxide - electrolyte - cathode is given by the following:

$$V = I \cdot R_K + V_A + V_R + V_K + I \cdot R_S \qquad (2)$$

Where $I$ = Current $R_K$ = resistance of ceramic oxide $V_A$ = Anode over-voltage $V_R$ = normal potential of the reaction $Al_2O_3 \rightarrow 2\ Al + 3/2\ O_2$ $V_K$ = concentration potential of the $Al^{3+}$ ions $R_S$ = resistance of the electrolyte between anode and cathode In the ceramic the voltage drop amounts to:

$$I \cdot R_K = I \cdot (d/A) \cdot \rho_K$$

Where $d$ = distance between the transition power-supply to ceramic $A$ = cross sectional area of the ceramic $\rho_K$ = specific resistance of the ceramic The following properties of the ceramic are required for the determination of the electrolyte resistance:

the temperature coefficient of the specific resistance should be negligible between 950° and 1000° C the voltage drop in the ceramic should be negligible in comparison with that in the electrolyte.

The ceramic oxide is connected to the positive pole of a direct current source and the other electrode with the negative pole, whilst the electrolyte completes the circuit. A voltmeter connected parallel to the power source is used to measure the change in voltage and an ammeter connected in series is used to measure the current.

At constant temperature, constant current I and unchanged geometry, a change in the voltage V of the measuring current gives a first approximation of the change in the electrolyte resistance $R_S$ and thereby the change in melt composition:

$$V_1 - V_2 = I \cdot (R_{S1} - R_{S2}) \quad (4)$$

Using equation (4) the change in the electrolyte resistance can be calculated:

$$R_{S1} - R_{S2} = (V_1 - V_2)/I$$

In order to prevent the level of aluminium in the cell from having an influence here, the anodically polarized ceramic oxide and the cathode, can be made to have constant geometry in a cell i.e. the aluminium does not form the cathode but instead a fixed cathode is provided.

Preferably, both electrodes are built into a rigid support which is a bad electrical conductor. The accuracy of measurement is improved if the electrodes are as far apart as possible and the measuring surface area is relatively small. In the case of the electrolysis of aluminium oxide a high degree of accuracy is needed with this measurement as the change in the specific electrical resistance is small.

The demands made on the ceramic oxide for the determination of the level of aluminium in the cell, are the same as those for the measurement of the electrical resistance:

The temperature coefficient of the specific resistance should be negligible between 950° and 1000° C.

The voltage drop in the ceramic should be negligible by comparison with that in the electrolyte.

The ceramic oxide is, as with the measurement of the resistance of the electrolyte, connected to the positive pole of a direct current source and the other electrode, which in this case can only be the liquid aluminium, is connected to the negative pole. The change in voltage of the measuring current flowing through the circuit, which is completed by the electrolyte, is measured by a voltmeter connected parallel to the power supply.

The voltage drop in the molten salt charge is calculated as follows:

$$I \cdot R_S = I \cdot (d'/A') \cdot \rho_S \quad (5)$$

Where $d'$ = distance between the anode and the top surface of the aluminium $A'$ = Area through which the current flows $\rho_S$ = specific resistivity of the molten electrolyte At constant temperature, constant current I, and constant specific resistance $\rho_S$ of the electrolyte a change in the voltage gives a first approximation of a change in the level of the aluminium:

$$d'_1 - d'_2 = (A'/I \cdot \rho_S) \cdot (V_1 - V_2) \quad (6)$$

Preferably, at the same time, the resistance of the electrolyte is measured using a second, independent measuring probe.

The following properties are required of the ceramic oxide for the determination of the temperature of the electrolyte:

the temperature gradient of the specific resistance should be as large as possible between 950° and 1000° C The voltage drop in the ceramic should be far greater than that in the electrolyte.

The ceramic oxide which is connected to the positive pole of a DC supply is preferably dipped so far into the electrolyte that the whole of the part through which the measuring current flows, is under the surface of the electrolyte.

By using a ceramic of high electrical resistivity any interference such as the change of the specific resistance of the melt or changes in the level of the aluminium are to a large extent out of the question. The upper limit of the resistance of the ceramic oxide is given by the requirement that the prescribed minimum current density needed to protect the ceramic surface should be possible without great expense. Thus the equation (2) is reduced to:

$$V \cong I \cdot R_K \quad (7)$$

For the measurement of the temperature of the melt the temperature dependence of the specific resistivity of the ceramic oxide anode is used. This dependence is especially pronounced for various ceramics in the range 950° - 1000° C. The temperature dependence of the electrical resistance of the melt can be neglected, thanks to the above mentioned conditions. In order to prevent the level of the aluminium from having any effect, the anodically polarized ceramic oxide is likewise partnered by a fixed, cathodically polarized electrode in a cell of a suitable, permanent geometry. The sides of the measuring probe must be completely protected by an inert, poorly conductive material (i.e., they must be electrically insulated) so that the whole of the measuring current flows through the ceramic and is not diverted through the better conducting electrolyte.

The cell is calibrated for a constant current at 950°-100° C. The voltage drop, which depends mainly on the specific resistance of the ceramic is recorded as a function of the temperature. This way the electrolyte temperature, as a function of the voltage drop, can be read directly from the reference curve.

If all three electrolyte parameters i.e. electrolyte resistance, level of the aluminium and the temperature of the electrolyte are to be determined, three measuring devices are necessary viz.

for measuring the resistance of the electrolyte — a ceramic electrode with relatively small specific resistance which has a negligable temperature coefficient, combined with a partner or counter electrode which is likewise fixed with respect to position and in a cell of fixed geometry; and for measuring the level of the aluminium — a ceramic with relative low specific resistance which has a negligible temperature coefficient; and for measuring the temperature of the electrolyte — a ceramic with relatively high specific resistance which has a large temperature coefficient, combined with a fixed partner or counter electrode in a cell of permanent geometry.

The decisive factor which makes possible the measurement of all three parameters is the availability of an anodically polarized ceramic oxide which is totally resistant to attack on the measuring surface and thus allows reproducible measurement.

Figure 4:
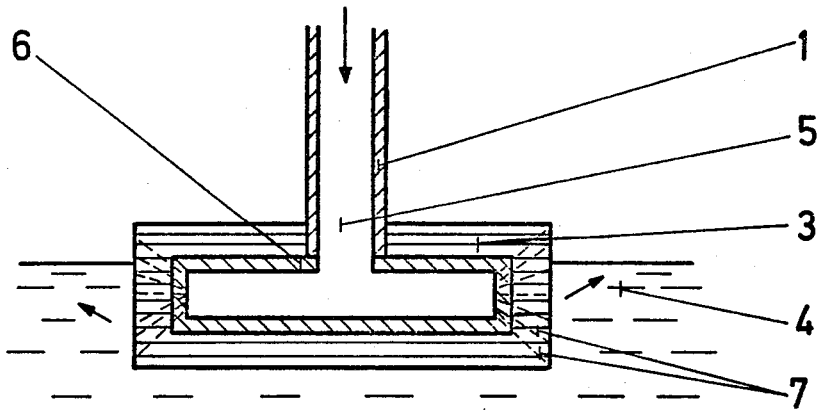
Figure 5:
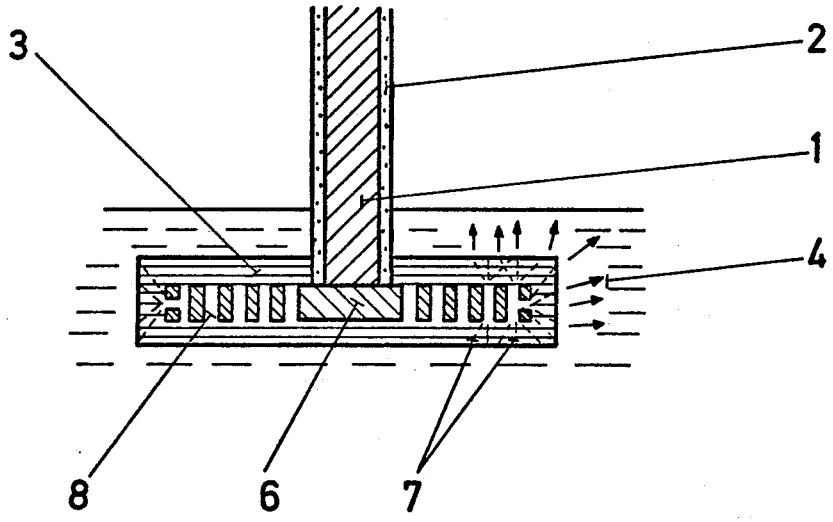
Figure 5:
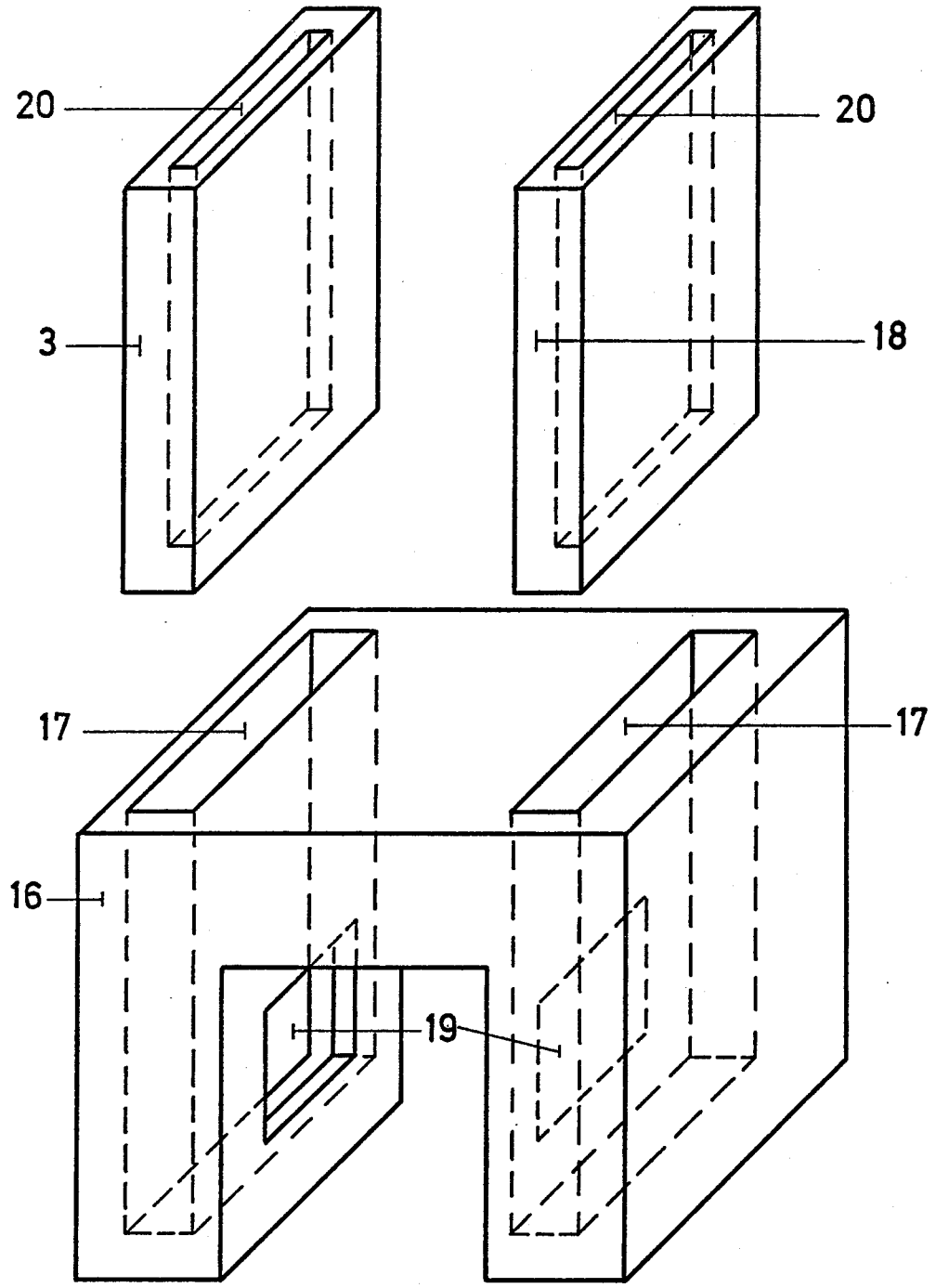
Figure 6:
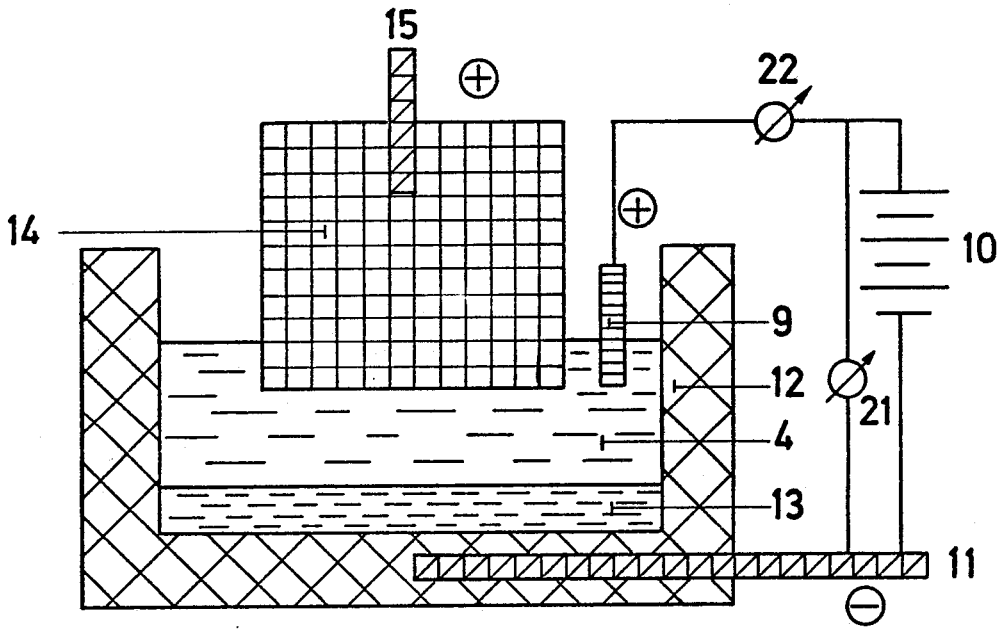

The drawings show schematically a number of versions of the device according to the invention as well as an electrolytic cell fitted out with the device, and consist of vertical sections in FIGS. 1-5 and 7, and a perspective view in FIG. 6

These are:

FIG. 1 a measuring probe with a full ceramic oxide cylinder and completely protected side wall.

Figure 2:
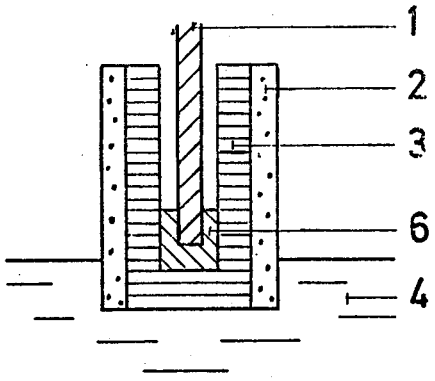

FIG. 2 a measuring probe with low metal-ceramic oxide contact resistance

Figure 3:
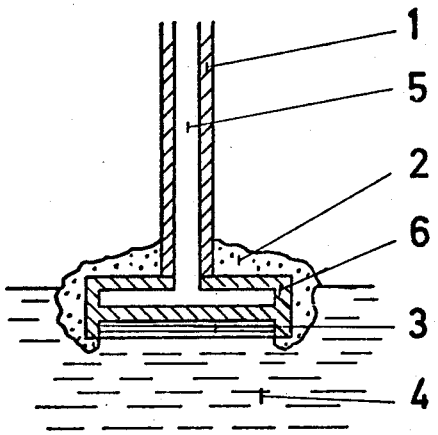

FIG. 3 a measuring probe with a ceramic oxide bottom plate and completely protected sides FIG. 4 a measuring probe which is protected by an oxidizing gas supplied from outside FIG. 5 a measuring probe with built-in partner electrode FIG. 6 an electrolyte cell with anodically polarized measuring probe.

The power lead to the probe is indicated by 1. It consists of metal or another electron conductive material such as carbide, nitride or boride. The protective layer 2 on the measuring device consists of a poorly conductive material which is also resistant to attack by the molten electrolyte. The ceramic oxide 3 consists, preferably, of doped $SnO_2$ and is at least partly in contact with the molten electrolyte 4.

In the embodiment according to FIG. 1 the protective layer 2 of the cylindrically shaped anode 3 of ceramic oxide material, is formed out of a ring of boron nitride, silicon nitride, electro-melted $Al_2O_3$ or MgO, which was previously cemented or sprayed on. This protective ring completely covers the side wall surface of the ceramic body 3 which is only partly immersed in the melt 4. In this way an almost uniform distribution of the measuring current is then achieved on the exposed, immersed bottom face.

It is not necessary in all cases, that the ring covers the whole of the side wall; it can also be smaller but it must at least protect the region in the three phase zone, where the probe is simultaneously in contact with the molten electrolyte and the surrounding atmosphere.

FIG. 2 is essentially the same as FIG. 1, but the power lead 1 is led in through a channel in the ceramic oxide 3, but without touching it and ends in a power distributor which has as small as possible a contact resistance with the ceramic oxide.

A built-in power distributor lowers the internal resistance of the anode and can help to attain a power distribution which is as uniform as possible over the unprotected, immersed anode surface. It can, as shown, be a massive body in the solid or liquid state, in the center of the anode. It can however, equally well be arranged in the region of the anode sides, for example in the form of a wire mesh.

The power lead 1 and the power distributor 6, as shown in here in the following figures, can in certain circumstances be made of the same material and can be manufactured in one piece. The power distributor must not enter into any kind of reaction with the ceramic material; it can also be employed as the substrate for a ceramic oxide layer.

In FIG. 3 the protective ring 2 is formed out of solidified electrolyte, whereby this crust can form spontaneously and in sufficient thickness, under favourable thermal conditions. This crust formation can if necessary be induced by means of a cooling agent passed through a channel 5 in the power lead 1.

The cooling system is designed in such a way that the sidewalls, which are formed by the power distribution 6, can be cooled too. Only the bottom plate 3, which is surrounded by the power distributor, is made of ceramic oxide material, the whole freely exposed lower face of the bottom plate is directly in contact with the melt.

The measuring probe shown in FIG. 4 is protected in those areas where the current density is too small, by an oxidizing gas which emerges in the region of the porous side wall surface. The ceramic oxide part 3 of the probe is at least partly in contact with the molten electrolyte 4. The oxidizing gas is led through the channel 5 in the power lead 1 and emerges with uniform distribution from holes in the power distributor 6 and pores 7 in the ceramic oxide on the side walls.

The power distributor 6 consists of a hollow body, situated in the center of the probe. It can for example consist of a wire mesh or a sintered body of electrically conductive powder; it must not react either with the oxidizing gas or with the ceramic oxide at the operating temperature.

In FIG. 5 measuring probe 17 can be combined with a fixed counter electrode; the precipitated liquid aluminium is in this case not used as cathode. For the determination of the resistance of the electrolyte the ceramic oxide and counter electrode are arranged preferably in a rigid, insulating holder. The frame-shaped holder shown in FIG. 5 has two rectangular shaped recesses 17 into which a ceramic oxide plate 3 and a plate-shaped electrode 18 are fitted, and also has two facing rectangular windows 19 which permit a direct connection between anode or cathode and the melt. The cathode plate 18 which serves as counter electrode is usually made of carbon in the form of calcined blocks or graphite. It can however also be manufactured out of other good, electron-conductive and electrolyte-resistant material which is at least partially composed of, for example, the borides, the carbides, the nitrides, or the silicides of the metals of the subgroup IV–VI of the periodic system, or mixtures thereof, preferably of the group IV elements carbon and silicon. Specific examples of suitable electrolyte-resistant materials include titanium carbide, titanium boride, zirconium boride or silicon carbide. As with the anode, the cathode can be made by known methods as a coating on a substrate.

Each of the electrode plates is provided with a recess 20 which is shaped in the form of a right angled parallelepiped and which permits the supply of power.

FIG. 6 shows a cell for the electrolysis of a molten charge, incorporating an anodically polarized measuring probe 9 which can correspond to one shown in FIGS. 1–5 and which is employed for the continuous measurement of electrolyte parameters.

The inconsumable measuring probe 9 immersed in the molten electroltye 4 is supplied from a DC source 10 which supplies either constant current with variable voltage, measured with the voltmeter 21, or with constant voltage and variable current measured with the ammeter 22. The negative pole of the DC source is connected either, as shown, to the power lead 11 of the cathodically polarized carbon tank 12 which contains the precipitated liquid aluminum 13, or to a counter electrode. The anode 14 of the electrolytic cell, which is connected to the positive power lead 15, can for example be made of carbon or ceramic oxide material.

EXAMPLE 1

A series of ceramic oxide probes of various composition was produced and investigated with respect to density and specific resistance.

Approximately 500 g of finely divided ceramic oxide material of high purity, with or without dopant material, was dry ground in a mixer for 10 minutes. 250 g of this was poured into a cylindrical Vinamold mold and manually compressed using an iron cylinder. The filled mold was then placed in the pressure chamber of an isostatic press. The pressure was raised within 3 minutes from 0 to 2000 kg/cm$^2$, held at maximum pressure for 10 seconds and finally reduced to zero again in the space of a few seconds. The unsintered ("green") sample was removed from the mold and polished. The green sample was then heated from room temperature to 1250° or 1600° C within 18 hours, held at 1250° C for 6 hr or at 1600° C for 2 hr and then cooled to 400° C over the following 24 hr. After reaching 400° C the sintered sample was taken out of the furnace, whereupon, after cooling to room temperature was weighed, measured and the density calculated.

The ratio of measured to theoretical density gives the percentage theoretical density of the sample:

$$\% \text{ theoretical density} = 100 \cdot \frac{\text{density of sample}}{\text{theoretical density}} \quad (8)$$

The purpose of the various additives is to reach by the minimum degree of doping, the desired density and specific resistance with appropriate temperature dependence for the measurement which is to be made.

The results are summarized in Table 1 with the composition of the ceramic oxide given in weight percent.

These results show that with various compositions a very high effective density can be reached.

Table 1 also gives information about the specific resistance at 20°, 950° and 1000° C.

TABLE 1

| Ceramic anode | % theoretical density | Specific Resistance (Ohm.cm) Average of several measurements 20° C | 950° C | 1000° C |
|---|---|---|---|---|
| $SnO_2$ | 62 | $1,5 \cdot 10^6$ | 112 | 35 |
| $SnO_2$ + 0,25% $Fe_2O_3$ | 99 | $10^6$ | 0,014 | 0,0079 |
| $SnO_2$ + 2% $Fe_2O_3$ | 96 | $10^6$ | 20 | 9,5 |
| $SnO_2$ + 5% $Fe_2O_3$ | 96 | $5,0 \cdot 10^5$ | 1,8 | 1,4 |
| $SnO_2$ + 10% $Fe_2O_3$ | 97 | $2,8 \cdot 10^5$ | 0,83 | 0,72 |
| $SnO_2$ + 2% $Sb_2O_3$ | 71 | 72,5 | 0,0095 | 0,0086 |
| $SnO_2$ + 1% $Sb_2$2,8 · 3 + 2% $Fe_2O_3$ | 96 | 7,1 | 0,062 | 0,062 |
| $SnO_2$ + 2% CuO | 98 | 16 | 0,035 | 0,035 |
| $SnO_2$ + 10% CuO | 92 | $10^5$ | 3,29 | 1,91 |
| $SnO_2$ + 2% CuO + 1% $Sb_2O_3$ | 94 | $5 \cdot 10^2$ | 0,005 | 0,005 |
| $SnO_2$ + 0,3% $MnO_2$ | 98 | $1,6 \cdot 10^6$ | 0,025 | 0,014 |
| $SnO_2$ + 2% $Nb_2O_5$ | 96 | $5 \cdot 10^3$ | 0,0056 | 0,0036 |
| $SnO_2$ + 0,5% ZnO | 99 | $5 \cdot 10^5$ | 1,95 | 1,125 |
| $SnO_2$ + 1% ZnO | 99 | $4,25 \cdot 10^5$ | 1,4 | 0,76 |
| $SnO_2$ + 2% ZnO | 99 | $3,1 \cdot 10^4$ | 0,505 | 0,425 |
| $SnO_2$ + 2% $Cr_2O_3$ | 68 | $2,0 \cdot 10^6$ | 160 | 63 |
| $SnO_2$ + 5% $Co_3O_4$ | 95 | $7,9 \cdot 10^5$ | 0,79 | 0,63 |
| $SnO_2$ + 2% $WO_3$ | 67 | $2,2 \cdot 10^4$ | 4,5 | 2,2 |
| $Cr_2O_3$ | 64 | $2,0 \cdot 10^4$ | 0,64 | 0,63 |
| $Co_3O_4$ | 85 | $7,0 \cdot 10^4$ | 0,072 | 0,125 |
| ZnO | 99 | $3,2 \cdot 10^4$ | 1,3 | 1,3 |

The values for the specific resistance given in Table 1, are average values from a series of measurements made on various samples of the same composition. The values given are therefore to be taken as guiding values; a deviation of up to a factor of 10 is possible, under certain circumstances, for individual samples.

Table 1 gives a choice of materials which allow optimum use of ceramic oxides in measuring probes, in accordance with the demands made on them.

The following materials are recommended preferably for the measurement of the resistance of the electrolyte and of the level of the aluminium:

$SnO_2$ + 2% $Sb_2O_3$ (not dense)
$SnO_2$ + 2% CuO + 1% $Sb_2O_3$
$SnO_2$ + 2% $Nb_2O_5$ All these materials have a specific resistance which is 50 to 100 times smaller than that of the electrolyte, and which with suitable arrangement of a cathodically polarised electrode in a cell of fixed geometry, is negligible.

A liquid silver contact for the transfer of power to the ceramic oxide is particularly suitable for keeping the contact resistance small and reproducible.

The following dense materials are recommended preferably for measuring the electrolyte temperature:

$SnO_2$ + 2% $Fe_2O_3$
$SnO_2$ + 10% CuO

If a lower density is permissible, for example, when using a stream of oxidising gas, then $SnO_2$ and $SnO_2$ + 2% $Cr_2O_3$ also come into consideration.

These materials have a specific resistance which, in particular in the optimum range for the electrolysis of aluminium viz. 950°-970° C, is far greater than that of the electrolyte. The temperature dependence of the specific resistance between 950° and 1000° C is relatively large.

EXAMPLE 2

The measurement of the temperature of the electrolyte melt is explained in greater detail with this example. Tin oxide with the following properties was used as base material for the manufacture of the ceramic oxide part of the measuring probe:

Purity: 99.9%
True density: 6.94 g/cm$^3$
grain size: < 5 μm $Fe_2O_3$ with the following properties was used as dopant:

Purity: 99%
True density: 4.87 g/cm$^3$
grain size: < 20 μm

The starting mixture used for the production of the ceramic oxide contained 98% $SnO_2$ and 2% $Fe_2O_3$ and was processed into 5-6 cm long, cylindrically shaped samples in the same way as described in example 1.

In a similar way to that shown in FIG. 1, these samples were cemented into a protective ring of highly sintered aluminium oxide, so that the ceramic was protected in the region of the three phase zone when dipped into the electrolyte later, and so that a uniform distribution of the measuring current would be produced over the free bottom face. The space between the protective ring and the ceramic was filled with a slurry of reduction plant alumina and sintered.

The cylindrical ceramic part of the measuring probe was secured near the upper end face between two "thermax" steel holders with curved gripping faces. The contact surfaces between steel holder and sample was about 1 $cm^2$. These holders were fixed to a Thermax rod of diameter 0.7 cm. Thermax served thus not only as the holder for the sample but also as the power lead.

The measuring probe was dipped 2 cm into the melt of the following composition:

| | |
|---|---|
| Cryolite | 1105 g = 85% |
| Reduction plant alumina | 130 g = 10% |
| $AlF_3$ | 65 g = 5% |

In order to come as close as possible to the conditions of industrial production of aluminium, over 100g of liquid aluminium was added to the melt which was contained in a graphite crucible 11 cm in diameter and 11 cm in depth; this condition corresponded to a cryolite melt which is saturated with respect to aluminium. The graphite crucible functioned as the cathode whilst the probe was anodically polarised.

A thermocouple which was protected by placing it in a highly sintered aluminium oxide tube, was arranged parallel to the ceramic oxide and immersed in the molten electrolyte to the same depth as the measuring probe.

The voltage drop between the clamps on the DC source was measured (see FIG. 6) at four temperatures between 950° and 1000° C, the temperature of the electrolyte being set with the aid of the thermocouple. Included in this value are all local voltage drop such as in the transition from power lead to the ceramic anode, the electrolysis process itself, the transition from the cathode power lead to the cathode etc.

Before the trials the specific resistance of the ceramic at 950° and 1000° C had been measured and the voltage drop in the ceramic oxide alone was calculated from this. The parameters and results of the trial are presented in Table II.

In a variation of the example the temperature of the electrolyte could be measured with a ceramic sample which is shielded completely in the region of the melt by an inert material which is also a bad electrical conductor. The ceramic oxide would in this case have the function of a temperature dependent resistance.

Table II

| | |
|---|---|
| Probe sample No. 564: | $SnO_2$ + 2% $Fe_2O_3$ |
| Density (% theoretical density): | 98.2 |
| Distance between contact point and bottom face: | 3.2 cm |
| Surface area of bottom face: | 5.6 cm |
| Height of protective ring: | 3.0 cm |
| Immersion depth: | 2.0 cm |
| Specific resistance 950° C: | 8.4 Ohm . cm |
| 1000° C: | 4.0 Ohm . cm |
| Power load: | 1.1 A |
| Current density: | 0.2 A/$cm^2$ |

| Thermocouple temperature (° C) | Voltage drop measured (V) | Voltage drop calculated (V) |
|---|---|---|
| 1000 | 3.0 | 2.52 |
| 990 | 3.6 | |
| 970 | 4.7 | |

-continued

| Thermocouple temperature (° C) | Voltage drop measured (V) | Voltage drop calculated (V) |
|---|---|---|
| 950 | 5.8 | 5.28 |

The results show that the measured voltage drop decreases approximately linearly with increasing temperature in the range 950°–1000° C, with current constant. A reference curve can be drawn using these values and with this curve the temperature can be read directly from the voltage drop noted.

EXAMPLE 3

A clarification should be made as to which minimum current density is necessary in order to protect from corrosion a ceramic oxide surface which is immersed in the molten electrolyte. The samples made of 98% $SnO_2$ and 2% $Fe_2O_3$ were produced under the same conditions as described in example 2, provided with a protective ring and dipped into the cryolite melt in the graphite crucible (see Example 2).

The immersed sample was exposed to the melt at first with no power superimposed, then stepwise, with increasingly higher current density which was held constant during each phase of the trials.

The amount of corrosion which had taken place in the ceramic oxide sample was measured with the aid of a sliding gauge (accuracy ≅ 0.1 mm) at the end of the trial period. The rate of corrosive attack on the bottom face was then calculated in $cm^3/cm^2$ and per hour.

The test parameters and results are presented in Table III.

TABLE III

| Trial No. | Duration of Trial (h) | Current density (A/$cm^2$) | Corrosion on the bottom face ($cm^3/(cm^2.h)$) |
|---|---|---|---|
| 1 | 42 | 0 | 0.00747 |
| 2 | 43.5 | 0.005 | 0.00141 |
| 3 | 42 | 0.025 | not measurable |
| 4 | 50 | 0.05 | not measurable |
| 5 | 42 | 0.49 | not measurable |

Table III shows that the samples with protective ring but with no superimposed current corrode markedly in the unprotected areas (Trial No. 1)

If a current density of 0.005 A/$cm^2$ is superimposed then there is clearly a reduced but still measurable amount of material removed (Trial No. 2).

On using a current density of 0.025 A/$cm^2$ the corrosion of the bottom face of the samples is no longer measurable. There is also no kind of attack to be seen on the bottom face of the anode; the length of the anode is unchanged (Trials 3, 4, 5).

EXAMPLE 4

It should be explained what minimum quantity of oxygen is necessary to protect from corrosion a ceramic oxide surface bearing no electric current.

The base material for the production of the samples was tin oxide which had the following properties:

Purity: 99.9%
True density: 6.94 g/$cm^2$
grain size: < 5 μm

Manganese dioxide was used as an aid to sintering. At least 0.3% $MnO_2$ is necessary to produce a dense $SnO_2$ ceramic. Since however, a porous sintered sample was wanted, only 0.1% $MnO_2$ was added to the base material, and the whole ground in a mixer for 20 minutes.

250 g of the mixture was taken and "green" samples 10 cm in length were prepared as described in Example 1. Finally a hole of 1 cm diameter and 5.5 cm deep was bored down the central axis of each of the cylindrically shaped samples, so that the wall thickness at the bottom was about 0.5 cm.

The "green" samples were heated in a furnace from room temperature to 1250° C over an interval of 18 hours, held at this temperature for 5 hours and then cooled to 400° C over the following 24 hour period. After reaching this temperature the sintered sample was taken out of the furnace and on cooling to room temperature was measured, weighed and the density calculated:

Outer diameter: 2.46 cm
Bottom face: 4.75 $cm^2$
Measured density: 4.53 $g/cm^3$
% theoretical density: 65.3

The comparison of the measured density with the theoretical density shows that the sintered sample is relatively porous.

The outer surface of the sample then had a highly sintered aluminum oxide ring of approximately the same length cemented on to it by filling the space between the sample and the ring with a slurry of reduction plant alumina and sintering the whole composite in such a way that one end of the protective ring was level with closed bottom face of the sample. Thus the closed bottom face of the porous tin-oxide sample was freely accessable while the outer surface area was completely or for the greatest part covered.

In the central hole which had been bored in the sample a highly sintered aluminum oxide tube was cemented in, in the same way, and preferably such that the tube reached to the end of the hole and projected out of the sample.

A sample thus prepared was dipped 2 cm into a cryolite melt whereby the melt and the graphite crucible corresponded to those described in Example 2.

Immediately after immersing the sample without superimposing a current on it, a specific amount of oxygen was passed through the aluminium oxide tube, whereby the said oxygen, because of the dense outer aluminium oxide ring and the likewise dense cladding in the hole, was forced to pass through the porous structure of the bottom face and to emerge uniformly distributed into the cryolite melt. The bottom face of the sample was then covered by a film of oxygen which was to prevent the reduction of the ceramic oxide.

After the trials the sample was taken out of the melt and cooled. The reduction in length of the ceramic oxide of the sample was measured with a sliding gauge and the specific removal of material due to corrosion calculated in $cm^3$ material per $cm^2$ per hour.

The test parameters and results are presented in table IV.

TABLE IV

| Trial (No.) | Duration of Trial (h) | Throughput of oxygen $\left(\frac{mmol}{cm^2.h}\right)$ | Corrosion of the bottom face $\left(\frac{cm^3}{cm^2.h}\right)$ |
|---|---|---|---|
| 1 | 42 | 0 | 0.0083 |

TABLE IV-continued

| Trial (No.) | Duration of Trial (h) | Throughput of oxygen $\left(\frac{mmol}{cm^2.h}\right)$ | Corrosion of the bottom face $\left(\frac{cm^3}{cm^2.h}\right)$ |
|---|---|---|---|
| 2 | 41 | 0.10 | 0.0014 |
| 3 | 42 | 0.25 | not measurable |
| 4 | 42 | 1.83 | not measurable |
| 5 | 41 | 11.2 | not measurable |

Table V shows that without the protection from oxygen the bottom face of the sample corrodes significantly. A throughput of only 0.1 mmol/($cm^2$.h) notably reduces the amount of material removed due to corrosion but there is still a measurable amount of attack. With an oxygen throughput of 0.25 mmol/($cm^2$.h) and more, attack of the bottom face of the sample could neither be measured nor observed.

It can be concluded from these results that the surface of the ceramic oxide is effectively protected from reduction due to aluminium in suspension and in solution, by an oxygen film which is produced without electric current.

What we claim is:

1. In a process for the continuous measurement of electrolyte parameters in an electrolysis cell during the production of aluminum therein by electrolysis of a melt containing an aluminum compound such as aluminum oxide, said cell having an anode and counter-electrode which carry the current for said electrolysis, the steps comprising:

inserting in said melt the measuring surface of a measuring probe whereof said measuring surface is ceramic oxide, said probe having a coating of an inert refractory electrically non-conductive material around its three-phase zone and over all inward surfaces thereof outside of said measuring surface adapted to prevent contact of said melt with said probe;

mantaining said measuring surface at a positive electrical potential with respect to a counter electrode therefor in said cell, said potential providing a current density of at least 0.01 amperes per square centimeter of measuring surface, whereby a measuring current is passed through at least a portion of said melt, and monitoring said measuring current and thereby determining the electrical parameters of said cell.

2. A process according to claim 1 in which the minimum current density is 0.025 A/$cm^2$.

3. A process according to claim 1 in which the shielding is provided by solidified electrolyte material.

4. A process according to claim 3 in which the solidification is brought about by localized cooling.

5. A process according to claim 1 in which the measuring surface of said probe is porous and a stream of gas is passed therethrough in an amount which is sufficient to prevent reduction of said ceramic oxide.

6. A process according to claim 5 in which the minimum flow of gas amounts to 0.25 mmol/($cm^2$.h).

7. A process according to claim 1 in which the ceramic oxide material is based upon oxide of tin, iron, chromium, cobalt, nickel or zinc.

8. A process according to claim 7 in which the base material of one of the oxides is doped with at least one other metallic oxide.

9. A process according to claim 8 in which the ceramic oxide is $SnO_2$ doped with at least one other metallic oxide in a concentration of 0.01 - 20% of each dopant oxide.

10. A process according to claim 9 in which the metallic component of the dopant oxide is selected from the group consisting of Fe, Sb, Cu, Mn, Nb, Zn, Cr, Co, W, Cd, Zr, Ta, In, Ni, Ca, Ba and Bi.

11. A process according to claim 1 in which the electrolyte is cryolite based.

12. A process according to claim 1 in which the electrolyte is oxide based.

13. A process according to claim 1 in which molten aluminum metal as it is formed separates and accumulates at the bottom of the cell; and said counter electrode comprises the said accumulated metal.

14. A process according to claim 1, wherein said ceramic oxide has a negligible temperature coefficient of electrical resistance with respect to the electrolyte in the temperature range at which the parameters are being determined; said counter electrode is fixed; and the measuring current is monitored to determine changes in the voltage of the measuring current under conditions of constant current in order to determine changes in the resistance of the electrolyte.

15. A process according to claim 1, wherein aluminum is produced as molten aluminum which subsequently flows to the bottom of the cell where a pool is formed; said ceramic oxide has a negligible temperature coefficient of electrical resistance with respect to the electrolyte in the temperature range at which the parameters are being determined; said counter electrode includes the pool; and monitoring the measuring current to determine changes in the voltage of the measuring current under conditions of constant amperage to indicate the amount of electrolyte separating the probe and the counter electrode in order to determine the change in level of the aluminum.

16. A process according to claim 14 in which is selected a ceramic oxide material which has a negligible specific electrical resistance compared with that of the electrolyte and which has a negligible temperature coefficient in the specific electrical resistance between 950° and 1000° C.

17. A process according to claim 16 in which said ceramic oxide consists of the materials $SnO_2$ + 2% $Sb_2O_3$,
$SnO_2$ + 2% CuO + 1% $Sb_2O_3$ or
$SnO_2$ + 2% $Nb_2O_5$.

18. A process according to claim 1, wherein said ceramic oxide has a relatively high temperature coefficient with respect to the electrolyte and in which the measuring current is monitored to measure a change in voltage over at least a part of the ceramic oxide in order to determine the temperature of the electrolyte.

19. A process according to claim 18 in which the ceramic oxide is dipped into the electrolyte to a sufficient depth that the whole of that part through which the measuring current flows is completely under the surface of the electrolyte.

20. A process according to claim 18 in which the side walls of the probe are completely shielded by an inert material which is also a bad electrical conductor.

21. A process according to claim 1 in which said ceramic oxide consists of the materials $SnO_2$ + 2% $Fe_2O_3$ or
$SnO_2$ + 10% CuO.

22. A process according to claim 18 in which said ceramic oxide has a large specific electrical resistance compared with that of the electrolyte and has a large temperature coefficient in the specific electrical resistance between 950° and 1000° C.

* * * * *